US010881233B1

(12) United States Patent
Walsh

(10) Patent No.: US 10,881,233 B1
(45) Date of Patent: Jan. 5, 2021

(54) THROUGH-DOOR PACKAGE DELIVERY ASSEMBLY AND RELATED METHODS

(71) Applicant: Patrick B. Walsh, Edgewater, FL (US)

(72) Inventor: Patrick B. Walsh, Edgewater, FL (US)

( * ) Notice: Subject to any disclaimer, the term of this patent is extended or adjusted under 35 U.S.C. 154(b) by 0 days.

(21) Appl. No.: 16/578,513

(22) Filed: Sep. 23, 2019

Related U.S. Application Data

(60) Provisional application No. 62/734,513, filed on Sep. 21, 2018.

(51) Int. Cl.
*A47G 29/124* (2006.01)
*E06B 7/28* (2006.01)

(52) U.S. Cl.
CPC ..... *A47G 29/1251* (2017.08); *E06B 7/28* (2013.01); *E05Y 2900/106* (2013.01)

(58) Field of Classification Search
CPC ..... A47G 29/12095; A47G 29/1251; A47G 29/14; A47G 29/16; A47G 29/22; A47G 2029/144; A47G 2029/148; E06B 7/28; E05Y 2900/106; B65G 11/04; B65G 11/12; E04F 17/12; B65F 1/1431
USPC ..... 232/19, 47, 51, 1 E, 44, 45, 43.5; 109/66; 193/8, 34; 220/479, 908
See application file for complete search history.

(56) References Cited

U.S. PATENT DOCUMENTS 845,964 A * 3/1907 Mittendorf ..... G07F 9/06 232/1 R
914,528 A * 3/1909 Thinnes ..... B65F 1/12 232/43.5
952,173 A * 3/1910 Zitko ..... B60N 3/083 220/477
2,829,820 A * 4/1958 Evers ..... A47G 29/1223 232/19
4,826,075 A 5/1989 Burns
5,368,226 A * 11/1994 Franceschino ..... A47G 29/1223 232/19
5,492,272 A 2/1996 Fewer
5,897,053 A 4/1999 Cirimele
7,240,823 B1 7/2007 Saidiazar
10,026,054 B1 * 7/2018 Staton ..... G06Q 10/0832
10,398,246 B2 * 9/2019 Crooks ..... A47G 29/22
10,413,106 B1 * 9/2019 Valeriano ..... E06B 7/32
10,512,351 B1 * 12/2019 Valeriano ..... E05B 47/0001
10,588,440 B1 * 3/2020 Kajgana ..... A47G 29/28
2002/0070269 A1 6/2002 Rosiello et al.
2017/0143146 A1 * 5/2017 Charbeneau ..... A47G 29/141
2018/0199745 A1 * 7/2018 Charbeneau ..... A47G 29/22
2018/0317687 A1 * 11/2018 Crooks ..... A47G 29/22
2020/0035051 A1 * 1/2020 Kane ..... G07C 9/00896

* cited by examiner

*Primary Examiner* — William L Miller
(74) *Attorney, Agent, or Firm* — Allen Dyer Doppelt & Gilchrist, PA

(57) ABSTRACT

A through-door package delivery assembly is mountable in a garage door or other mounting door. A delivery door of the assembly is operably connected to an internal chute so that moving the delivery door to a delivery position moves the chute to obstruct access through the mounting door. When the delivery door returns to a blocking position, the chute angles downwardly to deposit a package on the floor inside the mounting door. The assembly is also able to be carried by a garage door when it opens without impeding operation thereof.

22 Claims, 6 Drawing Sheets

Fig. 5
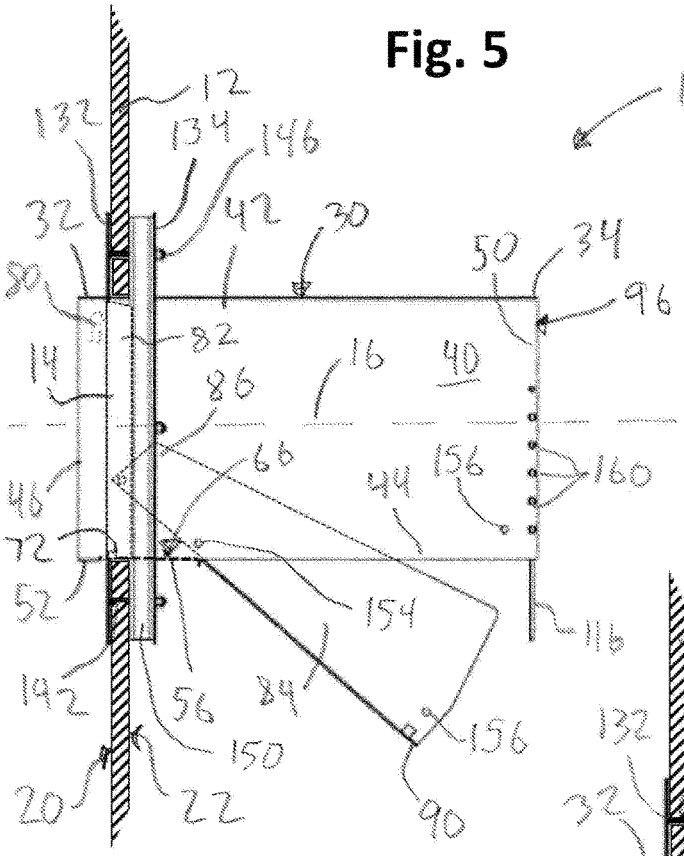
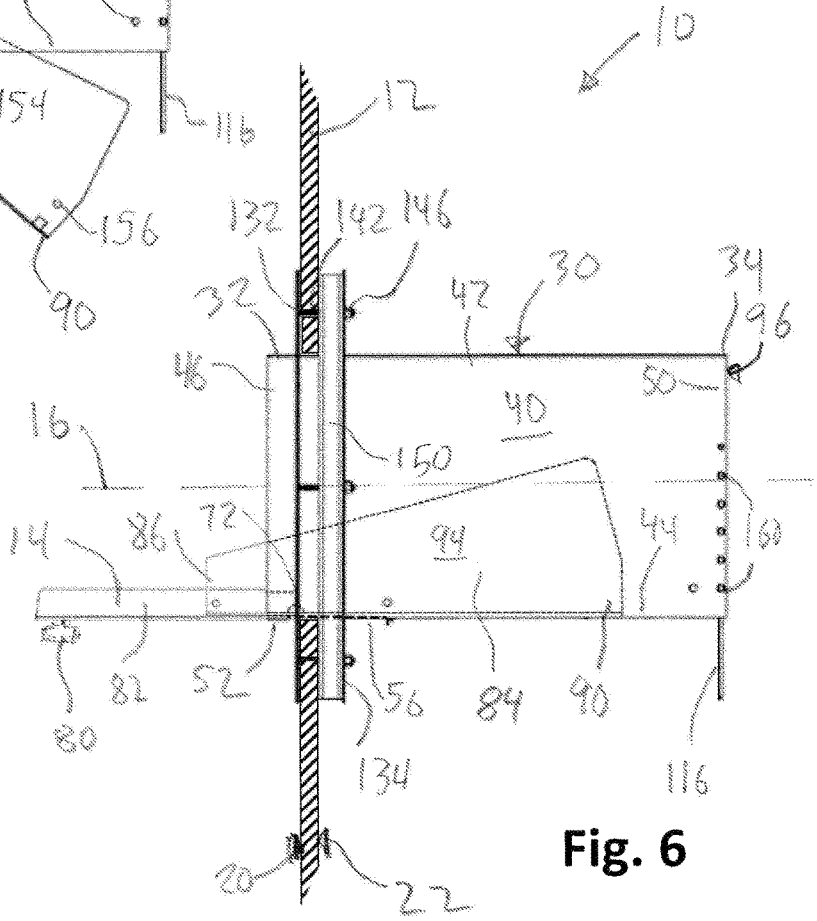
Fig. 6

THROUGH-DOOR PACKAGE DELIVERY ASSEMBLY AND RELATED METHODS

CROSS-REFERENCE TO RELATED APPLICATION

This application claims the benefit of U.S. Provisional Patent Application Ser. No. 62/734,513, filed on Sep. 21, 2018, the contents of which are herein incorporated by reference in their entirety.

BACKGROUND OF THE INVENTION

In the modern atmosphere of e-commerce, more and more purchases are delivered to homes and businesses via delivery services. It frequently occurs, particularly in the case of residential deliveries, that packages are dropped off when no one is available to accept them in person. As a result, the packages are left unsupervised on a porch or other entryway. A group of unethical people, often referred to as "porch pirates," takes advantage of this state of affairs by stealing delivered packages before the intended recipient arrives to claim them.

One solution is to have packages, which cannot be claimed immediately by the recipient, delivered to a monitored location. This option, while secure, is often extremely inconvenient for the recipient. Relatively secure postal boxes and mail slots also exist, but the size of many packages render them useless for this purpose. Accordingly, further improvements are possible.

SUMMARY OF THE INVENTION

In view of the foregoing, it is an object of the present invention to provide an improved through-door package delivery assembly and related methods. According to an embodiment of the present invention, a through-door package delivery assembly comprises a mounting door, a top wall, a pair of opposed sidewalls, a delivery door base, a delivery door, and a delivery chute. The mounting door is movable between open and closed positions and having opposite receipt and delivery sides, a delivery opening being defined in the mounting door extending between the receipt and delivery sides around a delivery axis.

The top wall extends along the delivery axis from a top wall receipt end, located proximate the receipt side, to a second top wall delivery end located inwardly of the delivery side, opposite top wall edges extending between the top wall receipt and delivery sides. The pair of opposed sidewalls each extends downwardly from a sidewall top edge, adjoining a respective one of the opposite top wall edges, to a sidewall bottom edge, each of the sidewall top and bottom edges extending from a sidewall receipt end, located proximate the receipt side, to a sidewall delivery end located inwardly of the delivery side.

The delivery door base extends between opposite base edges, each of the base edges adjoining a respective one of the sidewall bottom edges, the base edges extending along the delivery axis from a base receipt end, located proximate the receipt side, to a base delivery end located inwardly of the delivery side, the delivery door base having a base top face oriented toward the delivery axis. The delivery door extends from a delivery door bottom edge, pivotably connected to the delivery door base proximate the base receipt end, to a delivery door top edge, the delivery door being pivotable relative to the delivery door bottom edge between a blocking position, in which the delivery door covers the delivery opening between the top wall, the delivery door base and the pair of opposed sidewalls, and a delivery position, in which the delivery door uncovers the delivery opening, the delivery door having opposite receipt and delivery faces which, in the blocking position, are intersected by the delivery axis.

The delivery chute extends from a chute receipt end, pivotably connected to the delivery face, to a chute delivery end located inwardly of the delivery side, the delivery chute passing over the base top face, the chute delivery end being, with the delivery door in the blocking position, angled downwardly away from the delivery axis relative to the chute receipt end, movement of the delivery door into the delivery position pulling the chute receipt end outwardly of the delivery door bottom edge and pivoting the chute delivery end toward the delivery axis.

These and other objects, aspects and advantages of the present invention will be better appreciated in view of the drawings and following detailed description of preferred embodiments.

BRIEF DESCRIPTION OF THE DRAWINGS

FIG. 5 is a side view of the through-door package delivery assembly of FIG. 1, in a blocking position, with hidden components shown in broken lines;

FIG. 6 is a side view of the through-door package delivery assembly of FIG. 1, in a delivery position, with hidden components shown in broken lines.

DETAILED DESCRIPTION OF PREFERRED EMBODIMENTS

Figure 1:
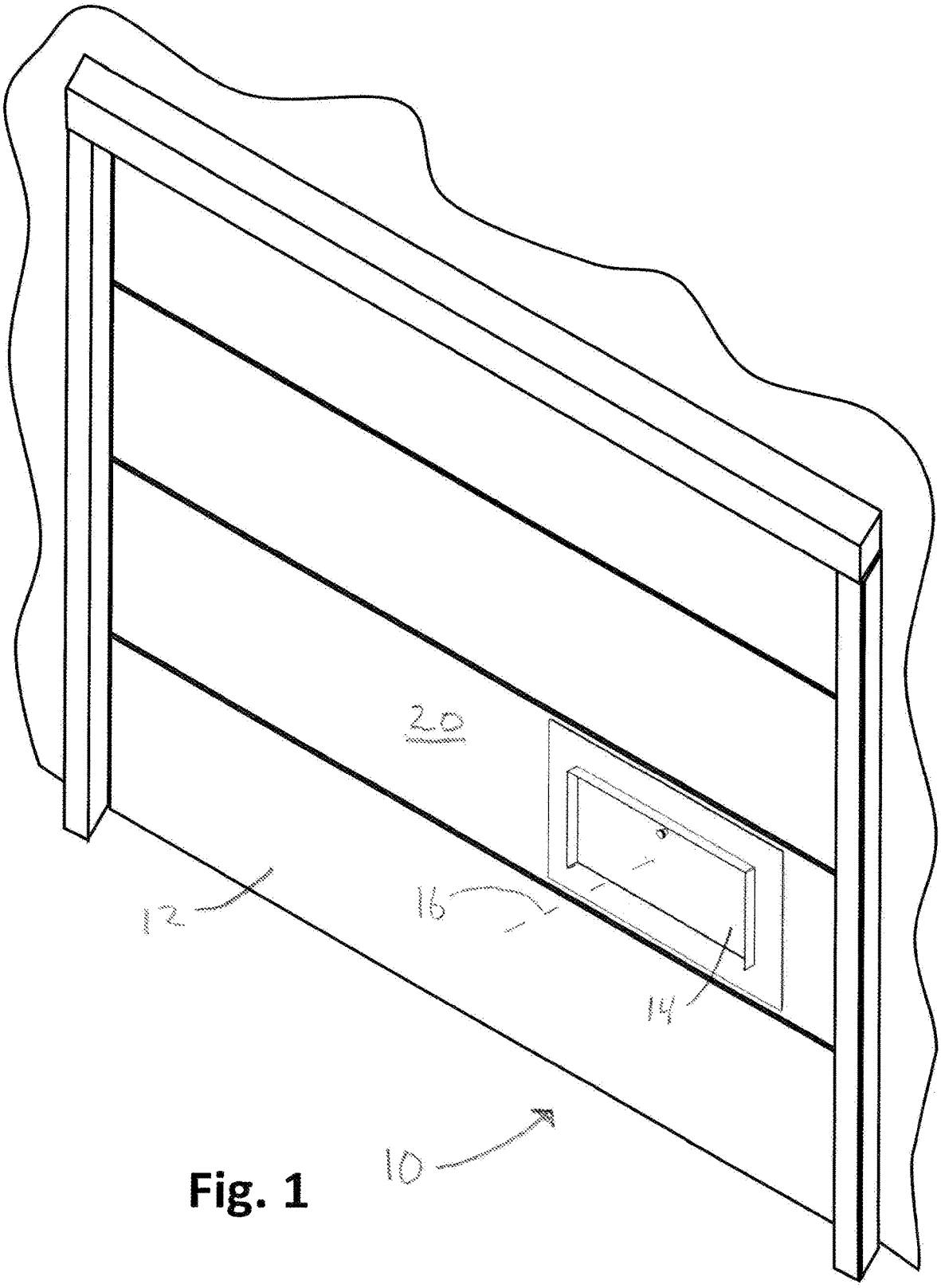
FIG. 1 is a perspective view of a garage door including a through-door package delivery assembly, according to an embodiment of the present invention.
Figure 2:
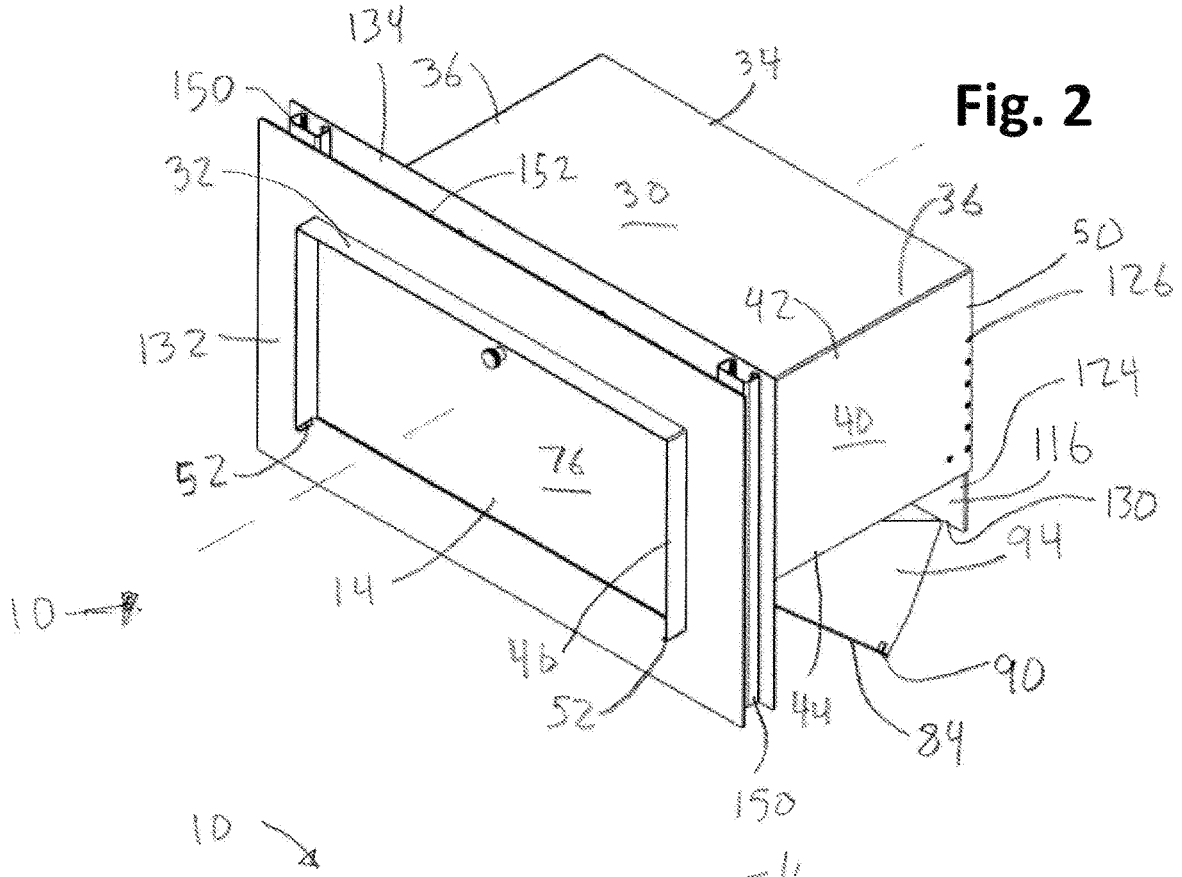
FIG. 2 is a perspective view of the through-door package delivery assembly of FIG. 1, without the garage door.
Figure 3:
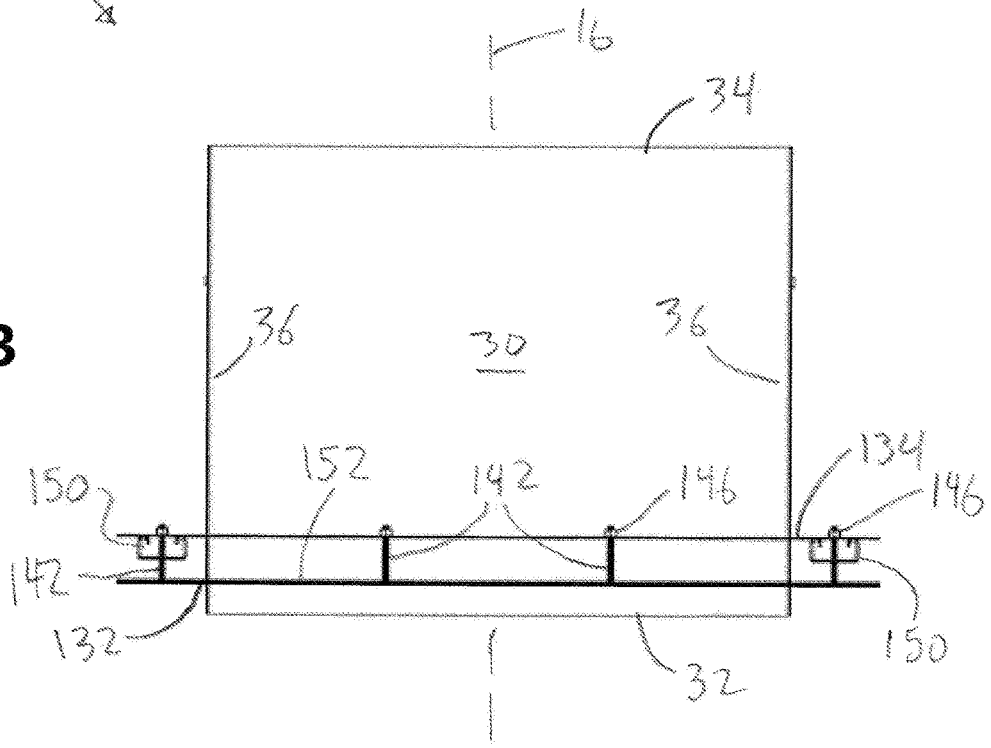
FIG. 3 is a top view of the through-door package delivery assembly of FIG. 1.
Figure 4A:
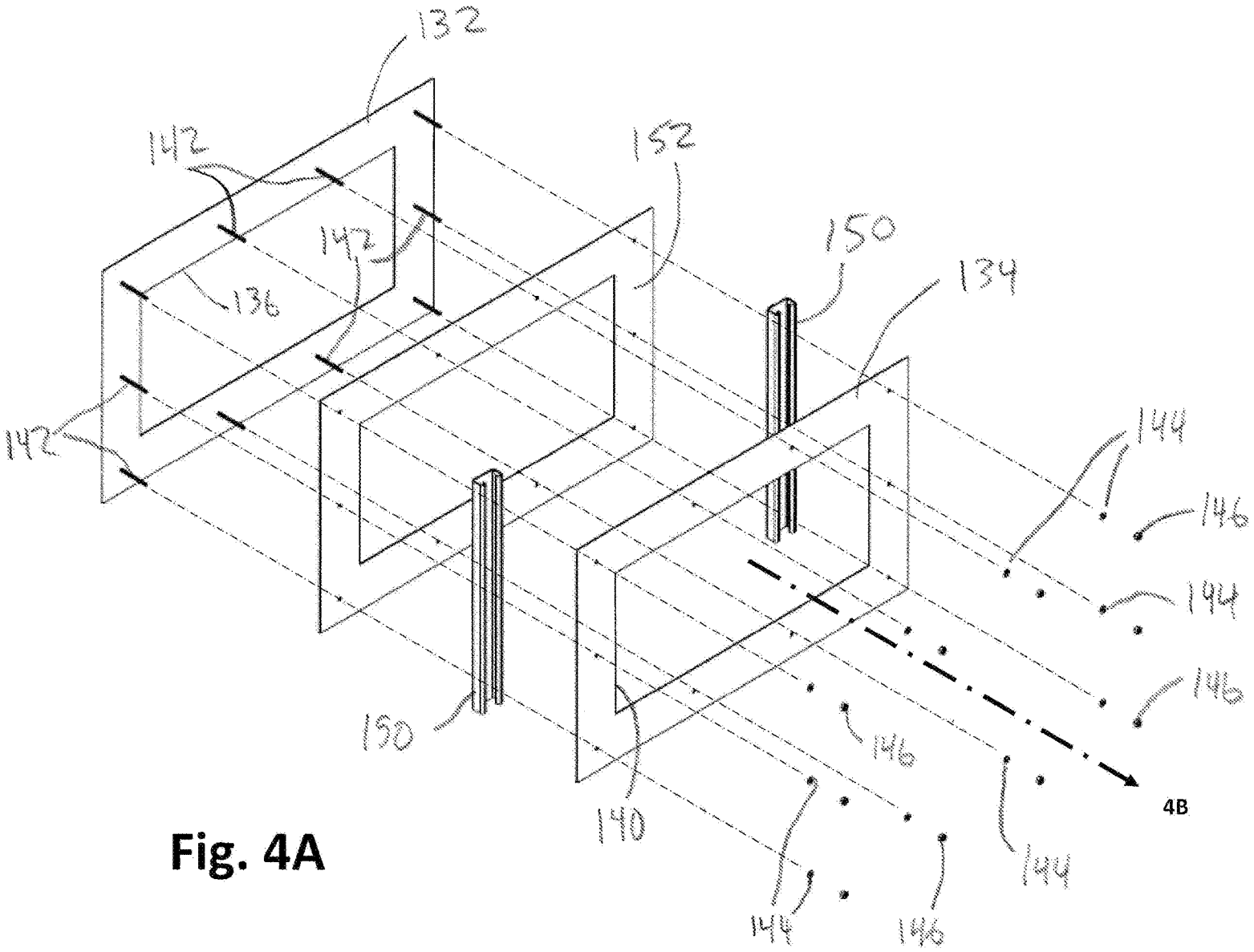
FIGS. 4A and 4B are an exploded perspective view of the through-door package delivery assembly of FIG. 1.
Figure 4B:
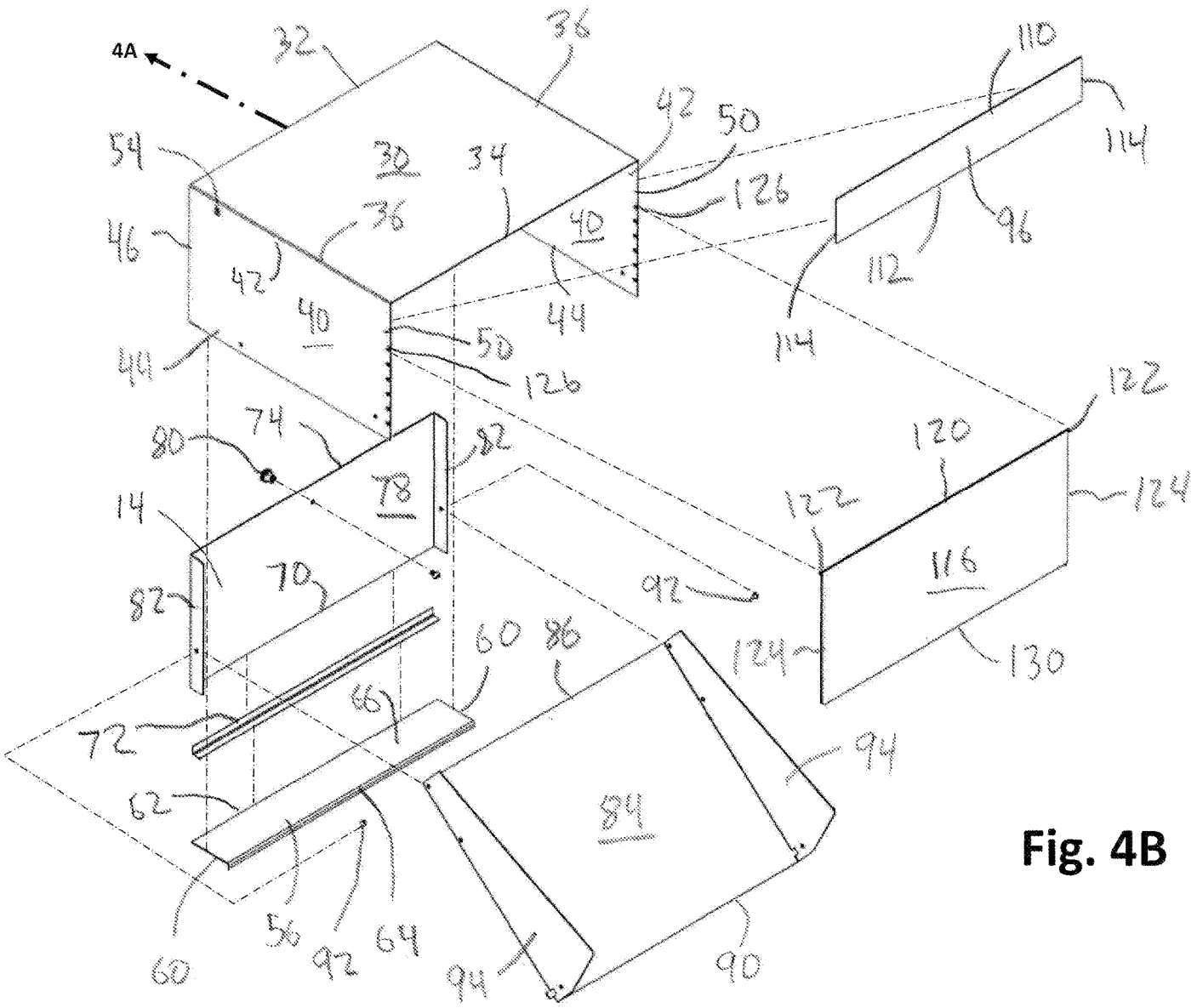

Referring to FIG. 1, according to an embodiment of the present invention, a through-door package delivery assembly 10 includes a mounting door 12 in which a delivery door 14 is mounted to selectively cover a delivery opening. As will be explained greater detail below, the assembly 10 allows packages to be delivered through the mounting door 12, thus reducing the likelihood of theft by continuing to effectively deny access through the door 12.

Referring also to FIGS. 2-4B, the assembly 10 extends through the delivery opening along a delivery axis 16 between a receipt side 20 of the mounting door 12 to a delivery side 22 (see, e.g., FIG. 5). As used herein, directional terms such as top and bottom are used with reference to the mounting door 12 being in a closed position (as in FIG. 1), in which the mounting door 12 is oriented substantially vertically, unless otherwise indicated.

Additionally, a referenced component is "inwardly" of another component if it is located further in the delivery direction along the delivery access. Likewise, a component is "outwardly" of another component if it is located further in the receipt direction along the delivery access. The use of these relative referential terms does not necessarily require the mounting door 12 to be a barrier between the inside and outside of a structure.

In the depicted embodiment, the delivery axis 16 is generally perpendicular to a plane of the delivery opening. However, an assembly 10 according to the present invention could accommodate a delivery axis arranged at a non-perpendicular angle relative to the delivery opening in the mounting door 12.

The depicted mounting door 12 is a garage door, which is vertically oriented when closed and horizontally oriented when open. It will be appreciated that the assembly 10 could be used in connection with other doors, including doors that remain vertically oriented between open and closed positions. Additionally, the assembly 10 could be incorporated into other substantially vertical barriers that are immovable, such as walls.

The assembly 10 includes a top wall that extends along the delivery axis 16 from a receipt end 32 to a delivery end 34. The receipt end 32 is proximate to, and preferably extends outwardly of, the receipt side 20. The delivery end 34 is located inwardly of the delivery side 22. Opposite edges 36 of the top wall 30 extend between the receipt and delivery ends 32, 34.

A pair of opposed sidewalls 40 each extends downwardly from a top edge 42 adjoining a respective one of the top wall 30 edges 36 to a bottom edge 44. The sidewalls 40 each extend from a receipt end 46 to a delivery end 50. The receipt end 46 is preferably located outwardly of the receipt side 20 proximate to the receipt end 32 of the top wall 30. The delivery end 50 is preferably located inwardly of the delivery side 22 proximate to the delivery end 34 of the top wall 30.

Advantageously, the top wall 30 and sidewalls 40 are formed from a single piece of material, such as steel, aluminum or other suitably durable and rigid material. Outwardly of the receipt side 20, the bottom edges 44 of the sidewalls 40 preferably curve toward each other at portions 52 to delimit motion of the delivery door 14, as will be described in greater detail below. Likewise, protrusions 54 preferably extend inwardly from the sidewalls 40 to delimit delivery door 14 motion.

A delivery door base 56 extends between base edges 60, each of which adjoins a respective sidewall bottom edge 44. A base receipt end 62 is proximate to the receipt side 20, and preferably inwardly of the sidewall receipt ends 46. A base delivery end 64 is preferably located well outwardly of the sidewall delivery ends 50, and preferably curves downwardly. A base top face 66 is oriented toward the delivery axis 16 and top wall 30.

The delivery door 14 extends from a bottom edge 70, connected proximate to the base receipt end 62 by a hinge 72, to a top edge 74. The delivery door 14 is pivotable relative to the delivery door base 56 between a blocking position, in which the door 14 covers the delivery opening between the top wall 30, the sidewalls 40 and the base 56, and a delivery position, in which the delivery opening is uncovered. With the delivery door 14 in the blocking position, opposite receipt and delivery faces 76, 78 intersect the delivery axis 16. Advantageously, a knob 80 extends outwardly from the receipt face 76 and lips 82 extend inwardly from opposite edges of the delivery door 14.

A delivery chute 84 extends from a receipt end 86 to a delivery end 90. The receipt end 86 is pivotably connected to the delivery face 80, preferably via connection to the lips 82 via pivot pins 92. The delivery chute 84 passes over the base top face 66. The chute 84 includes chute sidewalls 94 which preferably are accomodatable between the opposed sidewalls 40.

Preferably, a rear wall 96 extends from an upper edge 110, adjoining the top wall delivery end 34, to a bottom edge 112. Opposite rear wall sides 114 each adjoin a respective one of the sidewall delivery ends 50. Advantageously, the bottom edge 112 does not extend proximate to the sidewall bottom edges. Instead, a rear flap 116 is pivotably mounted between the sidewall delivery ends 50 below the bottom edge 112.

An upper end 120 of the rear flap 116 includes protrusions 122 extending beyond opposite sides 124, which are pivotably received in respective mounting holes 126 proximate the sidewall delivery ends 50. A lower end 130 of the rear flap 116 preferably hangs below the sidewall bottom edges 44.

First and second flanges 132, 134 are mounted on the receipt and delivery sides 20, 22, respectively. Respective first and second flange openings 136, 140 are defined in the first and second flanges 132, 134 and surround the delivery opening of the mounting door 12. A plurality of fasteners, such as bolts 142, washers 144 and nuts 146, connect the flanges 132, 134 to the mounting door. In particular, the bolts 142 extend from the first flange 132, through the mounting door (e.g., through holes drilled for that purpose) and through the second flange 134, where they are secured by the washers 144 and nuts 146.

Preferably, a pair of spacer struts 150 is advantageously mounted between the delivery side 20 and the second flange 134. Some of the bolts 142 extend through the spacer struts 150. A flange gasket 152 is compressed between the receipt side 20 and the first flange 132.

Advantageously, the second flange 134 is permanently fixed to the top wall 30, sidewalls 40 and delivery door base 56, with the first flange 132 being removably connectable to the second flange 134 via the fasteners. To install the assembly 10 in an existing mounting door 12, the delivery opening is cut through the mounting door 12 and holes for the bolts 142 are drilled in the appropriate locations. The first flange 132 and gasket 152 are placed against the receipt side 20 with the bolts 142 extending through their respective openings.

The rest of the assembly 10 is then inserted through the delivery opening until the bolts 142 extend through the second flange 134 and the spacer struts 150 are abutting the delivery side 20. Depending on the thickness of the mounting door 12, spacer struts having different thicknesses may be used, or the struts may be omitted. Preferably, the top wall and sidewall receipt ends 32, 46 extend outwardly of the receipt side 22 and first flange 134. The delivery door receipt face 76 (in the blocking position) and the base receipt end 62 are preferably proximate a plane of the first flange opening 136 (and inwardly of the top and sidewall receipt ends 32, 46).

In addition to being retrofitted into an existing mounting door 12, it will be appreciated that a through-door package delivery system according to the present invention could be integrated into a mounting door during construction. Depending on the particular mounting door configuration, one or both flanges might be omitted, with the remaining assembly attached directly to adjacent structure of the mounting door.

In use, referring more particularly to FIGS. 5 and 6, a delivery person encounters the assembly 10 with the delivery door 14 in the blocking position (as in FIG. 5). The person grasps the knob 80 to pivot the delivery door 14 into the delivery position (as in FIG. 6) about the hinge 72, with pivoting motion ultimately being stopped by the sidewall curved portions 52 (see FIG. 2).

Consequently, the chute receipt end 86 is pulled outwardly and downwardly by the delivery door 14 and the chute delivery end 90 pivots upwardly toward the delivery axis 16 and top wall 26. With the delivery door 14 open, the pivoted chute 84 impedes access from the receipt side 20 of the mounting door 12 to the area inside the mounting door 12—including access to any previously delivered packages.

The delivery person then inserts a package and closes (or simply releases) the delivery door 14. The delivery door 14 returns to the blocking position (with further pivoting being prevented by the protrusions 54 (see FIG. 4B)) and the chute delivery end 90 pivots downwardly away from the delivery axis 16 and top wall 26. The package then slides down the chute 84 from whence it is deposited onto the floor on the delivery side 22 of the mounting door 12. The assembly 10 is then ready for subsequent use.

It may be desirable to a user to be able to secure the delivery door 14 in the blocking position; for instance, when a user is present to receive packages in person or not expecting any packages. This can be achieved simply by inserting a locking pin through aligned locking openings 154 in either of the sidewalls 40 and the adjacent chute sidewall 94 with the delivery door 14 in the blocking position. Since the chute 84 delivery door 14 cannot be pulled forwardly, the delivery door 14 cannot be pivoted into the delivery position.

The delivery door 14 can also be secured in the blocking position with the chute 84 pivoted between the sidewalls 40. The chute 84 is simply pivoted upwardly towards the delivery axis 16 without moving the chute 84 forwardly, and a locking pin is inserted through aligned locking openings 156 in either of the sidewalls 40 and the adjacent chute sidewall 94.

It will be appreciated that the use of a pivotable rear flap 116 allows the assembly 10 to accept packages that are longer than the top wall 30 and sidewalls 40, while still obstructing the view through the delivery opening into the area behind the mounting door 12. If a user wishes to further restrict the size of packages that can be accommodated, one or more blocking rods can be inserted across the pairs of aligned blocking openings 160 located proximate the sidewall delivery ends.

Figure 7:
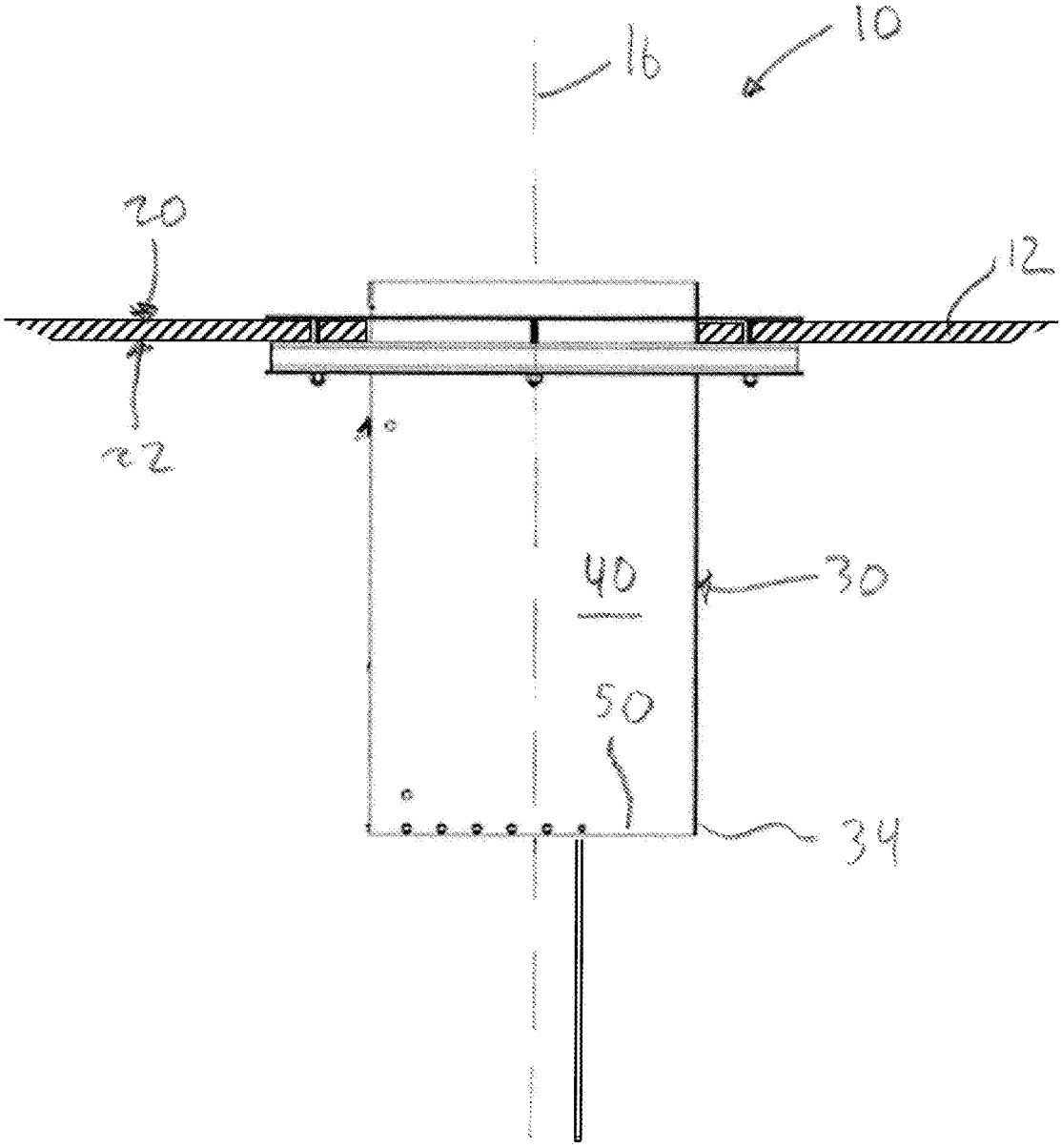
FIG. 7 is a side view of the through-door package delivery assembly of FIG. 1, with the garage door open.

The rear flap 116 is also able to provide a safety function. Referring to FIG. 7, with the mounting door 12 opened such that the delivery axis 16 extends vertically down, the rear flap 116 will hang well below the top wall and sidewall delivery ends. The flap 116 can accordingly be used to provide a warning to a user before passing below the assembly 10.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A through-door package delivery assembly, the assembly comprising:

a mounting door movable between open and closed positions and having opposite receipt and delivery sides, a delivery opening being defined in the mounting door extending between the receipt and delivery sides around a delivery axis;

a top wall extending along the delivery axis from a top wall receipt end, located proximate the receipt side, to a second top wall delivery end located inwardly of the delivery side, opposite top wall edges extending between the top wall receipt and delivery sides;

a pair of opposed sidewalls each extending downwardly from a sidewall top edge, adjoining a respective one of the opposite top wall edges, to a sidewall bottom edge, each of the sidewall top and bottom edges extending from a sidewall receipt end, located proximate the receipt side, to a sidewall delivery end located inwardly of the delivery side;

a delivery door base extending between opposite base edges, each of the base edges adjoining a respective one of the sidewall bottom edges, the base edges extending along the delivery axis from a base receipt end, located proximate the receipt side, to a base delivery end located inwardly of the delivery side, the delivery door base having a base top face oriented toward the delivery axis;

a delivery door extending from a delivery door bottom edge, pivotably connected to the delivery door base proximate the base receipt end, to a delivery door top edge, the delivery door being pivotable relative to the delivery door bottom edge between a blocking position, in which the delivery door covers the delivery opening between the top wall, the delivery door base and the pair of opposed sidewalls, and a delivery position, in which the delivery door uncovers the delivery opening, the delivery door having opposite receipt and delivery faces which, in the blocking position, are intersected by the delivery axis; and a delivery chute extending from a chute receipt end, pivotably connected to the delivery face, to a chute delivery end located inwardly of the delivery side, the delivery chute passing over the base top face, the chute delivery end being, with the delivery door in the blocking position, angled downwardly away from the delivery axis relative to the chute receipt end, movement of the delivery door into the delivery position pulling the chute receipt end outwardly of the delivery door bottom edge and pivoting the chute delivery end toward the delivery axis.

2. The assembly of claim 1, wherein the mounting door is a garage door.

3. The assembly of claim 1, wherein the delivery axis extends substantially perpendicularly to the mounting door.

4. The assembly of claim 1, further comprising a rear wall extending from a rear wall upper edge, adjoining the top wall delivery end, to a rear wall bottom edge, and between opposite rear wall sides, each of the opposite rear wall sides adjoining a respective one of the sidewall delivery ends.

5. The assembly of claim 4, wherein the rear wall bottom edge is located above the sidewall bottom edges.

6. The assembly of claim 5, further comprising a rear flap extending between a flap upper end, pivotably connected between the sidewall delivery ends proximate the rear wall bottom edge, to a flap lower end;

wherein, with the mounting door in the open position, the delivery axis is oriented downwardly and the rear flap hangs below the sidewall delivery ends.

7. The assembly of claim 5, wherein a plurality of pairs of aligned holes are defined through each of the pair of opposed sidewalls proximate the sidewall delivery ends.

8. The assembly of claim 1, further comprising a first flange mounted to the mounting door and defining a first flange opening surrounding the delivery opening, the first flange adjoining the top wall, the pair of opposed sidewalls and the delivery door base at the first flange opening.

9. The assembly of claim 8, further comprising a second flange mounted to the mounting door and defining a second flange opening surrounding the delivery opening, the second flange adjoining the top wall, the pair of opposed sidewalls and the delivery door base at the second flange opening;

wherein the first flange is located on the receipt side and the second flange is located on the delivery side, the first and second flanges being connected by a plurality of fasteners extending therebetween through the mounting door.

10. The assembly of claim 9, wherein the second flange is permanently fixed to the top wall, the pair of opposed sidewalls and the delivery door base and the first flange is removably connectable to the second flange using the plurality of fasteners.

11. The assembly of claim 9, further comprising a pair of spacer struts connected between the second flange and the delivery side.

12. The assembly of claim 8, further comprising a flange gasket defining a gasket opening surrounding the delivery opening, the flange gasket being sandwiched between the first flange and the receipt side.

13. The assembly of claim 1, wherein the top wall receipt end and the sidewall receipt ends extend outwardly of the receipt side and, in the blocking position, the delivery door is located inwardly of the top wall receipt end and the sidewall receipt ends.

14. The assembly of claim 13, wherein the base receipt end is located inwardly of the top wall receipt ends and the sidewall receipt ends, and, outwardly of the receipt side, at least one of the sidewall receipt ends curve under the delivery door to prevent further pivoting of the delivery door away from the delivery opening past the delivery position.

15. The assembly of claim 1, wherein a protrusion extends behind the delivery door from at least one of the pair of opposed sidewalls to prevent further pivoting of the delivery door into the delivery opening past the blocking position.

16. The assembly of claim 1, wherein the base delivery end is curved downwardly from the base top face.

17. A through-door package delivery assembly mountable along a delivery axis in a delivery opening of a mounting door movable between open and closed positions and having opposite receipt and delivery sides;

a top wall configured to extend, when mounted, along the delivery axis from a top wall receipt end, located proximate the receipt side, to a second top wall delivery end located inwardly of the delivery side, opposite top wall edges extending between the top wall receipt and delivery sides;

a pair of opposed sidewalls each extending downwardly from a sidewall top edge, adjoining a respective one of the opposite top wall edges, to a sidewall bottom edge, each of the sidewall top and bottom edges extending from a sidewall receipt end, located proximate the top wall receipt end, to a sidewall delivery end located proximate the top wall delivery end;

a delivery door base extending between opposite base edges, each of the base edges adjoining a respective one of the sidewall bottom edges, the base edges extending from a base receipt end, located proximate the sidewall receipt ends, to a base delivery end located partway between the sidewall receipt and delivery ends, the delivery door base having a base top face oriented toward the top wall;

a delivery door extending from a delivery door bottom edge, pivotably connected to the delivery door base proximate the base receipt end, to a delivery door top edge, the delivery door being pivotable relative to the delivery door bottom edge between a blocking position, in which the delivery door is configured to cover the delivery opening between the top wall, the delivery door base and the pair of opposed sidewalls, and a delivery position, in which the delivery door is configured to uncover the delivery opening, the delivery door having opposite receipt and delivery faces; and a delivery chute extending from a chute receipt end, pivotably connected to the delivery face, to a chute delivery end, the delivery chute passing over the base top face, the chute delivery end being, with the delivery door in the blocking position, angled downwardly away from the top wall, movement of the delivery door into the delivery position pulling the chute receipt end outwardly of the delivery door bottom edge and pivoting the chute delivery end toward the top wall.

18. The assembly of claim 17, further comprising a rear wall extending from a rear wall upper edge, adjoining the top wall delivery end, to a rear wall bottom edge, and between opposite rear wall sides, each of the opposite rear wall sides adjoining a respective one of the sidewall delivery ends.

19. The assembly of claim 18, further comprising a rear flap extending between a flap upper end, pivotably connected between the sidewall delivery ends proximate the rear wall bottom edge, to a flap lower end.

20. The assembly of claim 17, further comprising a first flange configured to be mounted to the mounting door and defining a first flange opening surrounding the delivery opening, the first flange adjoining the top wall, the pair of opposed sidewalls and the delivery door base at the first flange opening.

21. The assembly of claim 20, further comprising a second flange configured to be mounted to the mounting door and defining a second flange opening surrounding the delivery opening, the second flange adjoining the top wall, the pair of opposed sidewalls and the delivery door base at the second flange opening;

wherein the first and second flanges re-configured to be located on the receipt delivery sides, respectively, and connectable by a plurality of fasteners extending therebetween through the mounting door.

22. The assembly of claim 21, wherein the second flange is permanently fixed to the top wall, the pair of opposed sidewalls and the delivery door base and the first flange is removably connectable to the second flange using the plurality of fasteners.

* * * * *